US012677944B2

(12) United States Patent
Hendry

(10) Patent No.: US 12,677,944 B2
(45) Date of Patent: Jul. 14, 2026

(54) CABINET DRAWER MECHANISM

(71) Applicant: Jeffrey Scott Hendry, Birmingham, MI (US)

(72) Inventor: Edgar B. Hendry, Troy, MI (US)

(73) Assignee: Jeffrey Scott Hendry, Birmingham, MI (US)

( * ) Notice: Subject to any disclaimer, the term of this patent is extended or adjusted under 35 U.S.C. 154(b) by 223 days.

(21) Appl. No.: 18/584,539

(22) Filed: Feb. 22, 2024

(65) Prior Publication Data

US 2024/0277142 A1 Aug. 22, 2024

Related U.S. Application Data

(60) Provisional application No. 63/447,518, filed on Feb. 22, 2023.

(51) Int. Cl.
*A47B 88/423* (2017.01)
*A47B 88/483* (2017.01)

(52) U.S. Cl.
CPC ..... *A47B 88/423* (2017.01); *A47B 88/483* (2017.01)

(58) Field of Classification Search
CPC ..... A47B 88/407; A47B 88/48; A47B 88/60; A47B 88/944; A47B 88/483; A47B 88/936; A47B 2210/0005; A47B 2210/0056
See application file for complete search history.

(56) References Cited

U.S. PATENT DOCUMENTS 2,650,871 A * 9/1953 Holderegger ..... A47B 88/48 16/374
2,653,852 A * 9/1953 Bissman ..... A47B 88/497 312/334.36
3,850,482 A * 11/1974 Gutner ..... A47B 88/43 384/22
4,582,372 A * 4/1986 Cooper ..... A47B 81/002 312/307
5,427,447 A * 6/1995 Satoh ..... B60N 3/102 297/188.17
6,409,061 B1 * 6/2002 Fischer ..... B60N 3/102 224/281
6,575,542 B2 * 6/2003 Shimajiri ..... B60N 3/102 312/332
8,770,683 B2 7/2014 Rehage
10,149,539 B2 12/2018 McGregor et al.
12,042,047 B1 * 7/2024 Toner ..... A47B 88/956
(Continued)

FOREIGN PATENT DOCUMENTS

DE 102017121596 3/2019
DE 102010036741 10/2020

*Primary Examiner* — Daniel J Rohrhoff
(74) *Attorney, Agent, or Firm* — Carlson, Gaskey & Olds, P.C.

(57) ABSTRACT

A cabinet drawer includes a drawer body, a drawer face movable with respect to the drawer body, and a guide bar attached to an underside of the drawer body. The guide bar includes a first end and a second end. The first end includes a first projection and the second end includes a second projection. Each of the first and second projections extend away from the underside of the drawer body. The second projection is configured to engage with a cabinet as a pivot point to urge the drawer face to move with respect to the drawer body. A cabinet and a method of displacing a cabinet drawer are also disclosed.

20 Claims, 12 Drawing Sheets

(56) References Cited

U.S. PATENT DOCUMENTS

| | | | | |
|---|---|---|---|---|
| 2009/0079314 | A1* | 3/2009 | Lu | A47B 88/40<br>312/334.44 |
| 2017/0181544 | A1* | 6/2017 | McGregor | A47B 88/427 |
| 2020/0191472 | A1* | 6/2020 | Dubina | F25D 23/028 |
| 2022/0386773 | A1* | 12/2022 | Huffman | A47B 81/002 |

* cited by examiner

CABINET DRAWER MECHANISM

CROSS-REFERENCE TO RELATED APPLICATIONS

This application claims priority to U.S. Provisional Patent Application No. 63/447,518 filed Feb. 22, 2023; the disclosure of which is incorporated by reference in its entirety herein.

BACKGROUND

Cabinet drawers typically include a drawer face with a handle or fixture on the front that, depending on the arrangement of the cabinet with respect to other drawers, can interfere with the path of adjacent drawers when it is pulled out of a corner space. Extra space is often required in the corner so that corner drawers can be pulled out. However, the needed extra space may limit the allowable size of corner drawers, and can also diminish aesthetic appeal of such drawer arrangements.

SUMMARY

A cabinet drawer according to an exemplary embodiment of this disclosure, among other possible things includes a drawer body, a drawer face movable with respect to the drawer body, and a guide bar attached to an underside of the drawer body. The guide bar includes a first end and a second end. The first end includes a first projection and the second end includes a second projection. Each of the first and second projections extend away from the underside of the drawer body. The second projection is configured to engage with a cabinet as a pivot point to urge the drawer face to move with respect to the drawer body.

In a further example of the foregoing, the drawer body includes a first bracket on a front side of the drawer body and the drawer face includes a second bracket on a back side of the drawer face. The first bracket is configured to receive the second bracket such that the drawer face can slide with respect to the drawer body.

In a further example of any of the foregoing, the second projection has a first portion extending from the guide bar and a second portion rotatably connected to the first portion.

In a further example of any of the foregoing, the guide bar is attached to the underside of the drawer body via the first projection.

In a further example of any of the foregoing, the guide bar extends through an opening in the drawer body such that the second projection is situated outside of the drawer body.

In a further example of any of the foregoing, the first end of the guide bar is attached to a back of the drawer face.

A cabinet according to an exemplary embodiment of this disclosure, among other possible things includes a guide member. The the guide member includes a first section defined along a first axis, a second section defined along a second axis, and an offset segment connecting the first and second sections. The cabinet also includes a drawer. The drawer includes a drawer body, a drawer face movable with respect to the drawer body, and a guide bar attached to an underside of the drawer body. The guide bar includes a projection extending away from the underside of the drawer body and configured to engage with the offset segment of the guide member such that the projection acts as a pivot point to urge the drawer face to move with respect to the drawer body.

In a further example of the foregoing, the first axis and the second axis are approximately parallel.

In a further example of any of the foregoing, the first section of the guide member is longer than the second section of the guide member.

In a further example of any of the foregoing, the first section of the guide member is received in a slot in a front wall of the cabinet.

In a further example of any of the foregoing, the second section of the guide member is attached to a back wall of the cabinet.

In a further example of any of the foregoing, the projection is a second projection. The cabinet also includes a first projection, the guide bar being attached to the underside of the drawer body via the first projection.

In a further example of any of the foregoing, the guide bar extends through an opening in the drawer body such that the projection is situated outside of the drawer body.

In a further example of any of the foregoing, the guide member includes first and second guide rails a wall joining the first and second guide rails. The projection is configured to be received between the first and second guide rails.

In a further example of any of the foregoing, the projection is configured to engage with the first and second guide rails in the offset section to move the drawer face with respect to the drawer body.

A method of displacing a cabinet drawer according to an exemplary embodiment of this disclosure, among other possible things includes moving a cabinet drawer with respect to a cabinet. The cabinet drawer includes a drawer body, a drawer face movable with respect to the drawer body, and a guide bar attached to an underside of the drawer body with a projection extending therefrom. The projection is engaged with a guide member including a first section defined along a first axis, a second section defined along a second axis, and an offset segment connecting the first and second sections such that the projection engages with the offset segment to urge the drawer face to move with respect to the drawer body.

In a further example of the foregoing, wherein the guide member includes first and second guide rails and a wall joining the first and second guide rails. The projection is received between the first and second guide rails and engages one of the first and second guide rails to urge the drawer face to move with respect to the drawer body.

In a further example of any of the foregoing, the guide bar extends through an opening in the drawer body such that the projection is situated outside of the drawer body.

In a further example of any of the foregoing, the first section of the guide member is longer than the second section of the guide member.

In a further example of any of the foregoing, the drawer is movable within the cabinet via drawer slides.

DETAILED DESCRIPTION

The present disclosure relates to a cabinet drawer mechanism that can be used with cabinet drawers that are perpendicular to one another in a corner.

On the underside of a cabinet drawer is a cabinet drawer mechanism including a guide member that is attached to the cabinet and a guide bar that is attached to the cabinet drawer such that the guide member is situated below guide bar. The guide member and the guide bar are configured to urge the face of the drawer in a horizontal direction relative to the body of the drawer as the drawer is pulled outward. This allows the drawer face to avoid handles/fixture on adjacent drawers, eliminating the need for extra space between corner cabinets.

Figure 1A:
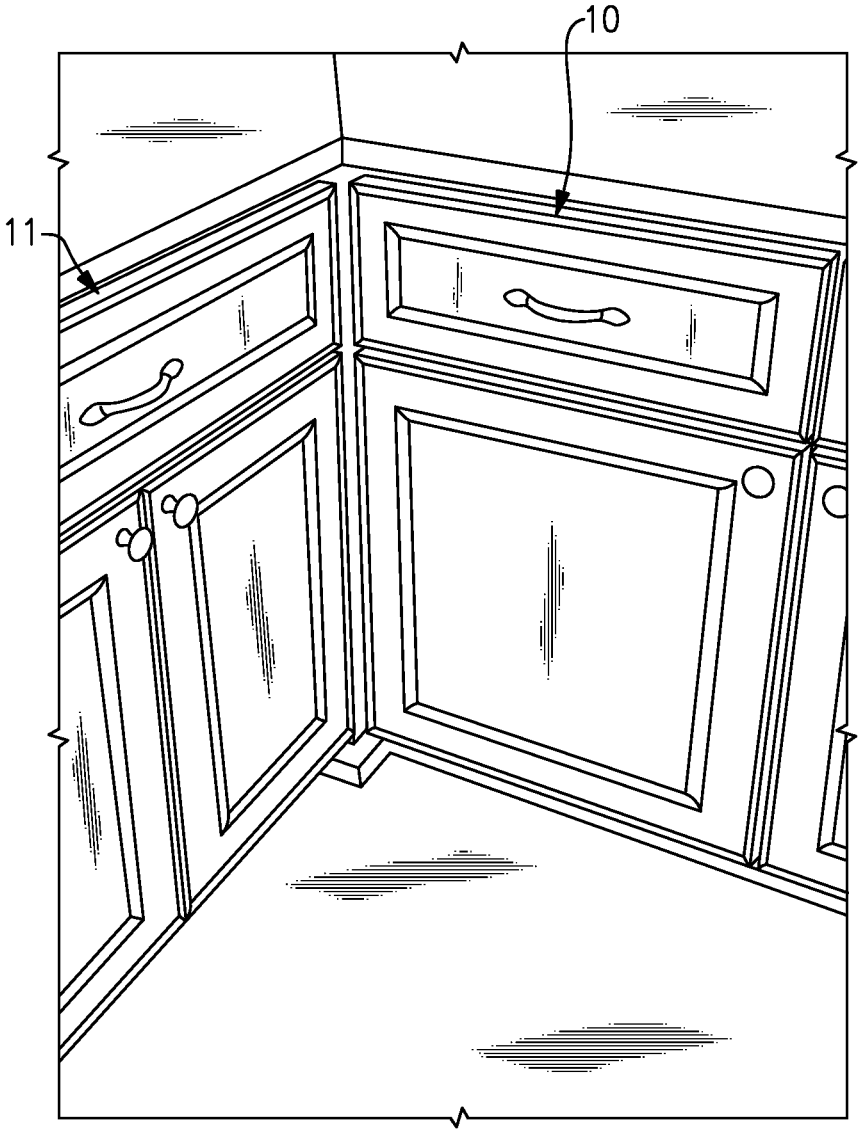
FIG. 1A shows a cabinet drawer arrangement including an example cabinet with cabinet drawer.

FIG. 1A illustrates an example corner cabinet drawer arrangement. In the illustrated example, an example cabinet drawer 10 is situated next to an adjacent cabinet drawer 11. Normally, a side portion of the drawer 10 interferes with a handle or fixture of the adjacent drawer 11 when the drawer 10 is pulled outward. However, as will be discussed in more detail below, the drawer 10 is configured to be laterally moveable such that there is no interference. While the following description is specifically directed towards the cabinet drawer 10, it is equally applicable to the adjacent drawer 11.

Figure 1B:
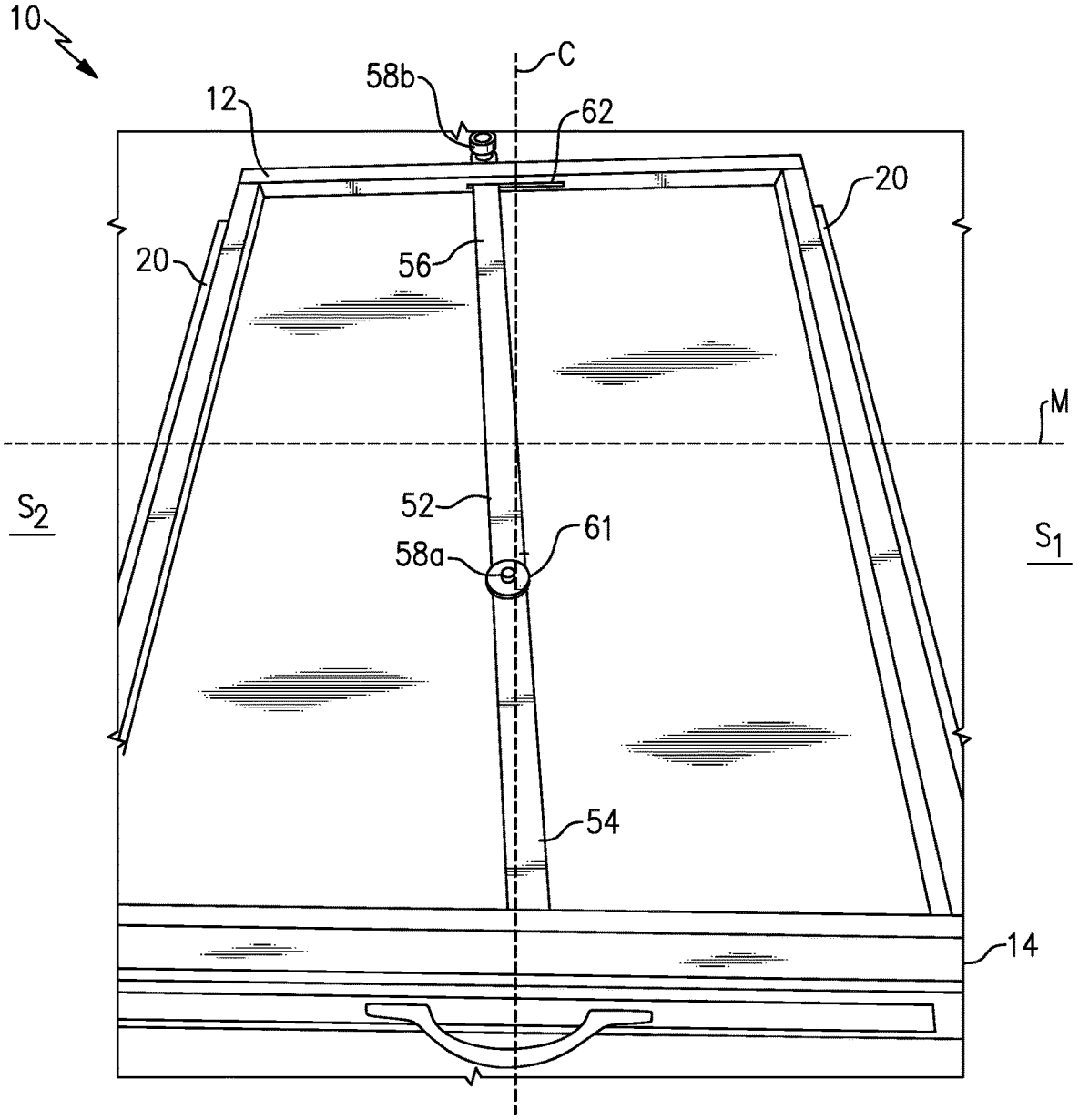
FIG. 1B illustrates an underside of the cabinet drawer of FIG. 1.

FIG. 1B illustrates an underside of the example cabinet drawer 10. The drawer 10 includes a drawer body 12 that is attached to a drawer face 14. The drawer face 14 is separate and distinct from the drawer body 12 in one example (see also FIG. 4).

Figure 2:
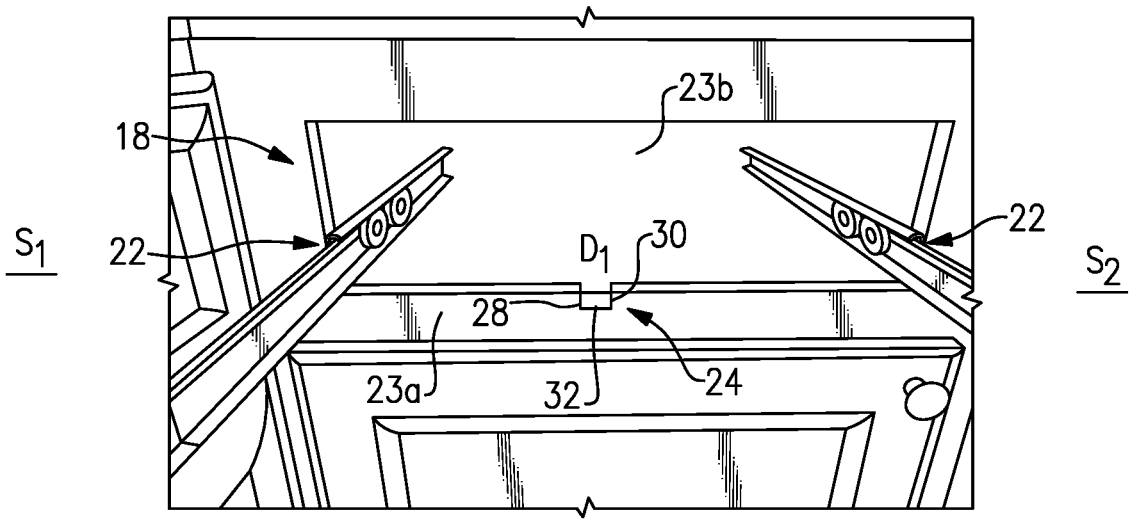
FIG. 2 illustrates the cabinet of FIG. 1 with the drawer in an extended position.

Referring to FIG. 2 with continued reference to FIG. 1B, the drawer body 12 is configured to be supported in a cabinet 18 via a pair of supports 20 on either side of the drawer body 12. In the illustrated example, the cabinet 18 includes drawer slides 22 such as telescoping slides that are configured to receive the supports 20, respectively, so that the cabinet drawer 10 can slide along the slides 22 to transition between an open position and a closed position. Drawer slides are well known in the art and will not be discussed further herein.

In the illustrated example of FIG. 2, the cabinet 18 includes a front wall 23*a* and a back wall 23*b*. The front wall 23*a* includes a slot 24. In one example the slot 24 includes a first wall 28, a second wall 30 that is spaced apart from the first wall 28, and a third wall 32 that connects the first and second walls 28/30 to form a U-shape. The first and second walls 28/30 are spaced apart by a distance $D_1$. Note, although the slot 24 is shown as having a U-shape, the slot 24 could form another shape. As will be discussed below, the slot 24 is shaped to receive a component that corresponds to the shape of the slot 24.

The terminology "first" and "second" as used herein is to differentiate that there are two distinct components or features. It is to be further understood that the terms "first" and "second" are interchangeable in the embodiments herein in that a first component or feature could alternatively be termed as the second component or feature, and vice versa.

Figure 3:
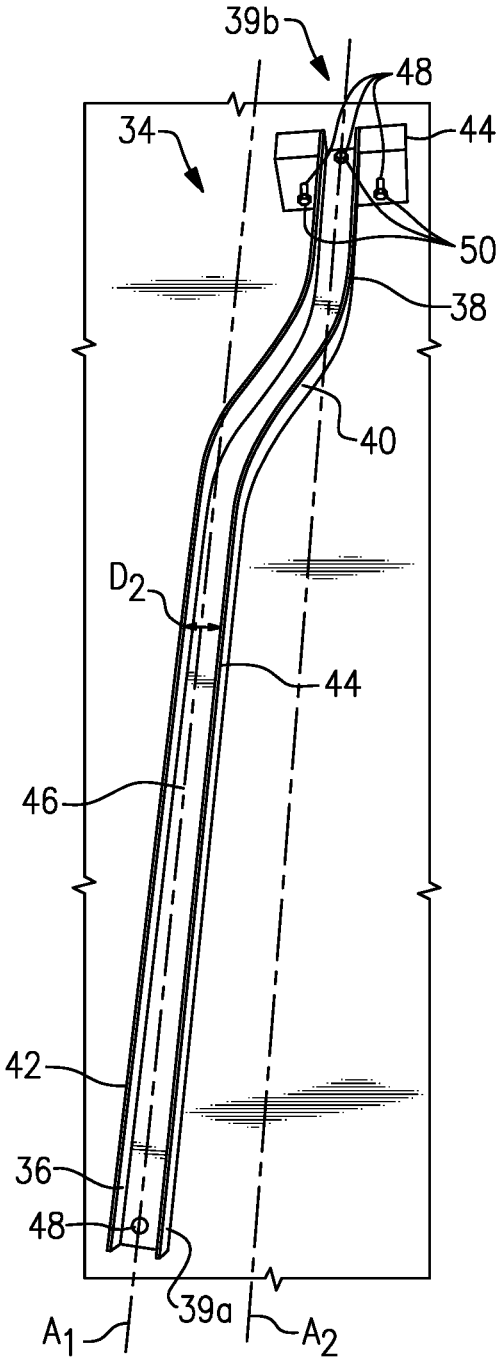
FIG. 3 illustrates an exemplary guide member for the cabinet drawer of FIG. 1.

FIG. 3 illustrates an example guide member 34 that includes a first section 36, a second section 38, and offset segment 40 that connects the first section 36 to the second section 38. The offset segment 40 creates a bend in the guide member 34. In the illustrated example, the guide member 34 includes a first wall or guide rail 42, a second wall or guide rail 44 that is spaced apart from the first guide rail 42, and a third wall 46 that connects the first and second guide rails 42/44 to form a generally U-shaped component.

The first section 36 and the second section 38 of the guide member 34 are configured to be attached to the cabinet 18. Specifically, the guide member 34 extends between a front end 39*a* in the first section and the back end 39*b* in the second section. The first section 36 is configured to to be attached to the front wall 23*a* of the cabinet 18 at the front end 39*a* while the second section 38 is configured to be attached to the back wall 23*b* of the cabinet 18 at the back end 39*b*. The first section 36 is received in the slot 24 in the front wall 23*a* (FIG. 2). In one example, the guide rails 42/44 are spaced apart by a distance $D_2$ that is less than the distance $D_1$ of the slot 24. In one example, the first and second guide rails 42/44 of the first section 36 and the second section 38 are parallel to one another and track the curvature of the guide member 34.

In one example, one or both of the first section 36 and the second section 38 can include an aperture such as the aperture 48 at the front end 39*a* which is configured to receive a fastener 50 to fasten the guide member 34 to the cabinet 18. In another example, one or both of the first section 36 and the second section 38 include an attachment block such as attachment block 44 at the back end 39*b*. In this example, the attachment block 44 can include the apertures 48 configured to receive fasteners 50 for attaching the guide member 34 to the cabinet 18. In the particular example of FIG. 3, the second section 38 includes an attachment block 44 for attaching the guide member 34 to the back wall 23*b* of the cabinet 18. The guide member 34 can also be attached to a cabinet in other ways, such as by an adhesive.

In the example of FIGS. 2 and 3, the first section 36 and the second section 38 of the guide member 34 are offset due to the offset segment 40. In this example, the first section 36 is positioned towards a first side $S_1$ relative to the centerline C of the body 12 and the second section 38 is positioned towards a second side $S_2$ relative to the centerline C of the body 12 (see FIG. 1B). In one particular example, the first section 36 extends along a first longitudinal axis $A_1$ and the second section 38 extends along a second longitudinal axis $A_2$. In a particular example, the axes $A_1/A_2$ are approximately parallel. In another particular example, the second longitudinal axis $A_2$ is closer to parallel than perpendicular relative to the first longitudinal axis $A_1$.

In one example, the length of the first section 36 is larger than the length of the second section 38 and the offset segment 40. In a further example, the length of the first section 36 is more than double the length of the second section 38 while the length of the second section 38 and the offset segment 40 are approximately the same. In this example, the offset segment 40 is closer to a back end 39*b* of the guide bar 34 than it is to the front end 39*a*.

Referring to FIGS. 1B and 4-7, the underside of the cabinet drawer 10 includes a guide bar 52. The guide bar 52 includes a first or front end 54 corresponding to the front 23*a* of the cabinet and a second or back end 56 corresponding to the back 23*b* of the cabinet. The front end 54 includes a first projection 58*a*, and the back end 56 includes a second projection 58*b* that both extend out in a downward direction away from the underside of the drawer 10.

The first projection 58*a* is a pivot point for the guide bar 52. In one example, the first projection 58*a* protrudes through the underside of the body 12 and through the guide bar 52 so that the guide bar 52 is attached to the body 12. The guide bar/first projection 58*a* may be secured in this manner with a nut 61 or any other suitable attachment.

The second projection 58*b* is configured to be received between the first and second guide rails 42/44 of the guide member 34 so that the second projection 58*b* can slide between them.

Figure 5:
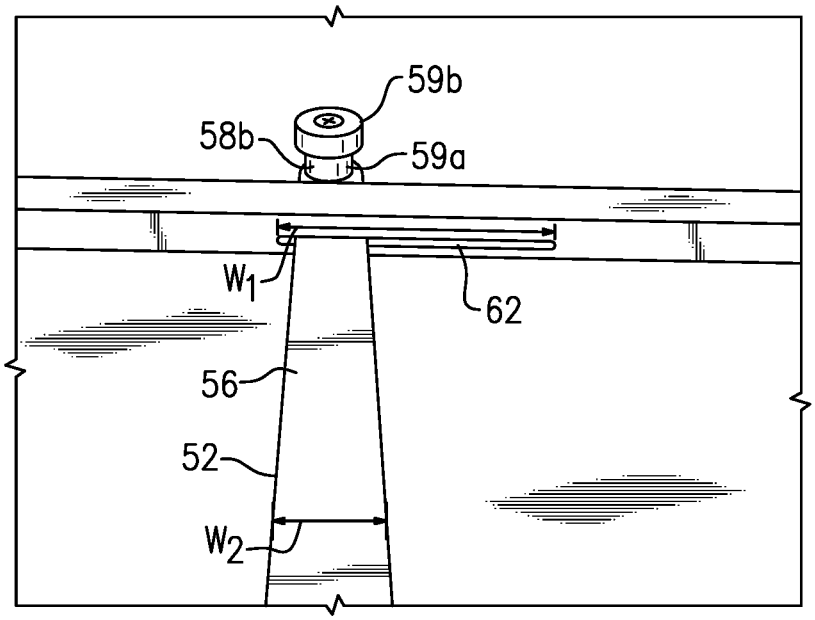
FIG. 5 illustrates a guide bar for the cabinet drawer of FIG. 1.
Figure 6:
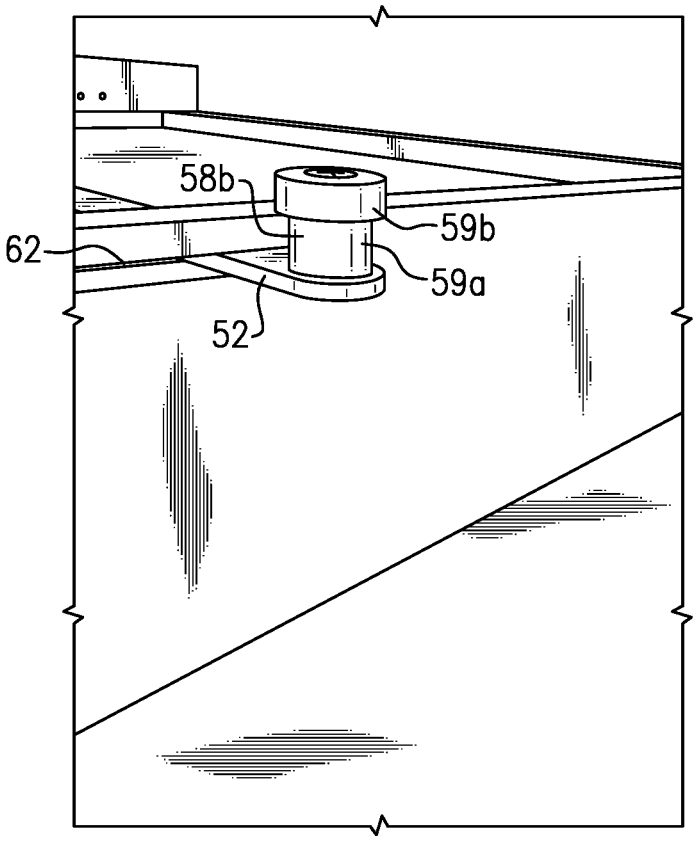
FIG. 6 illustrates a detail view of a projection on the guide bar of FIG. 5.

Referring to FIGS. 1B, 5, and 6, the second projection 58*b* includes a first portion 59*a* and a second portion 59*b*. The first portion 59*a* extends out from the guide bar 52 and connects to the second portion 59*b*. In this example, the second portion 59*b* is rotatably connected to the first portion 59*a* such that the second portion 59*b* can rotate relative to the first portion 59*a* to facilitate sliding of the second projection between the guide rails 42/44. In one example, the second portion 59*b* is configured to be received between the first and second guide rails 42/44 of the guide member 34 so that the second projection 58*b* can slide between them. In the illustrated example, the second portion 59*b* has a larger diameter than the first portion 59*a*. In one example, the diameter of the second portion 59*b* is approximately the same as the distance $D_2$ between the first and second guide rails 42/44.

The projections 58*a*/58*b* can have the same or different geometry. In one example, the second projection 58*b* is longer and/or has a larger diameter than the first projection 58*a*. In one example, the first projection 58*a* is positioned in front of the midline M of the drawer body 12 (e.g., it is positioned between the midline M and the front of the drawer body 12) while the second projection 58*b* is positioned at or near the bat end 56 of the guide bar 52 (see FIG. 1B). In a particular example, the first projection 58*a* is positioned in front of the midline M at a location that is about one-third of the length of the drawer body 12 while the second projection 58*b* is positioned at the rear end 56 of the guide bar 52.

The drawer body 12 includes a first or front opening 60 (see FIG. 4) that is configured to receive the front end 54 of the guide bar 52 and a second or rear opening 62 (see FIG. 1B) that is configured to receive the rear end 56 of the guide bar 52.

Figure 4:
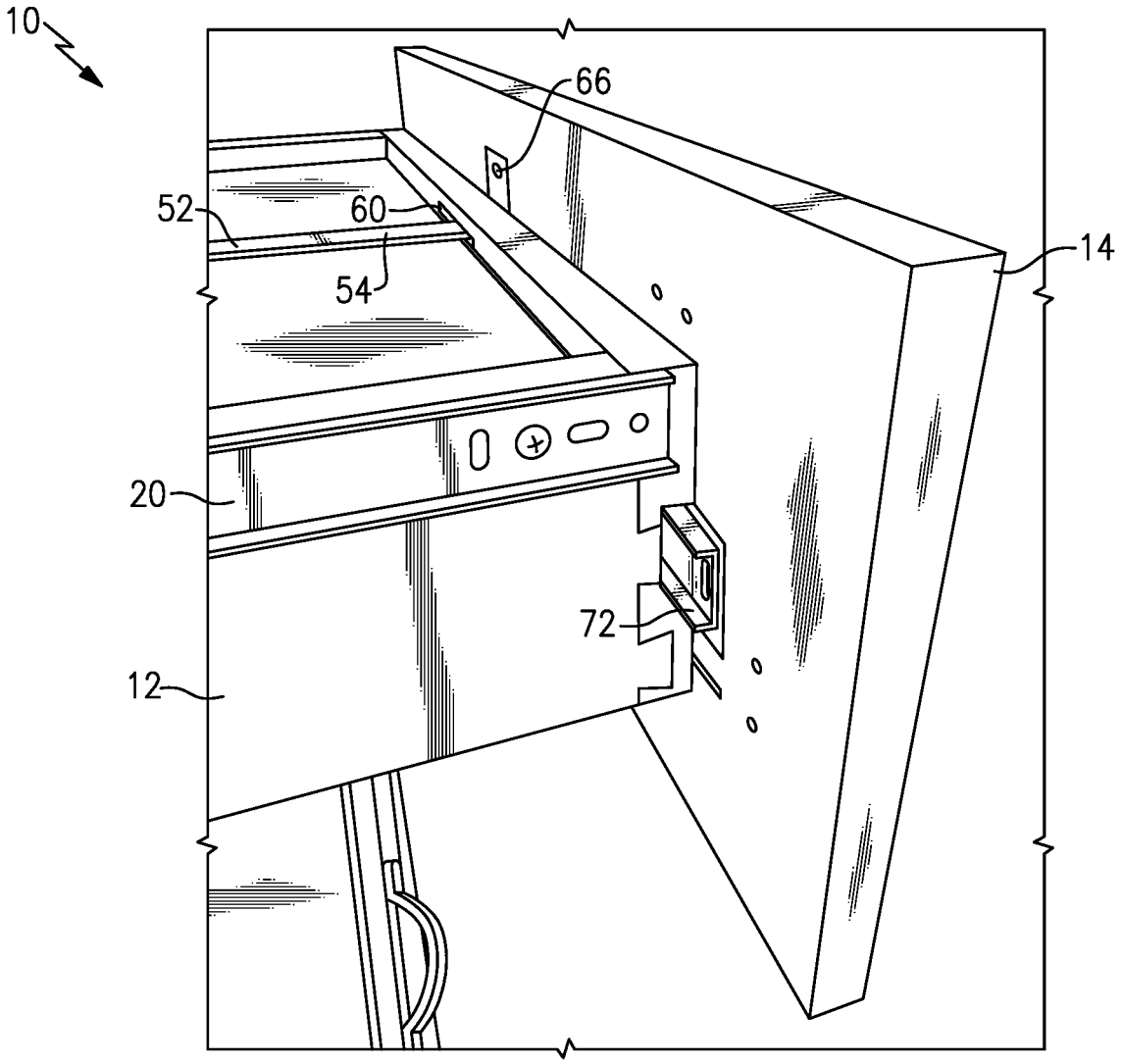
FIG. 4 illustrates a perspective view of the cabinet drawer of FIG. 1.
Figure 7:
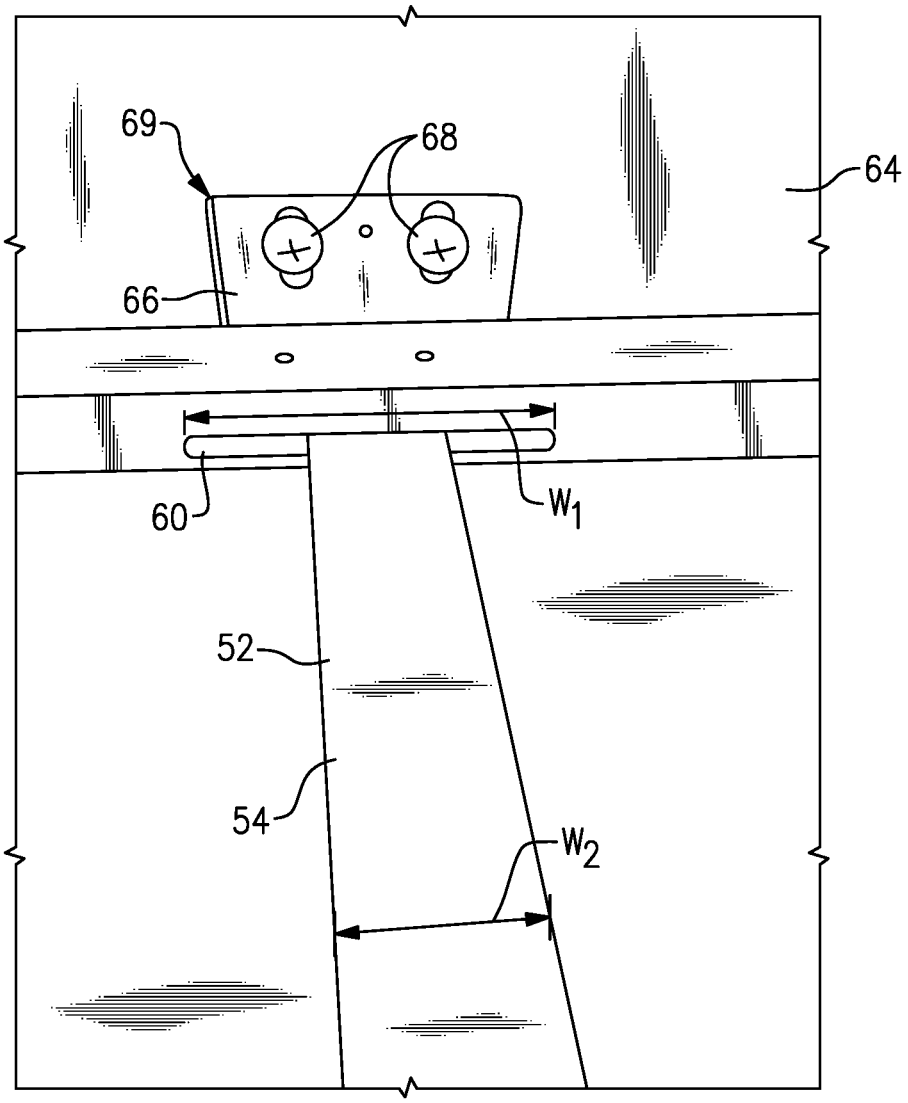
FIG. 7 illustrates a detail view of an interface between the guide bar of FIG. 5 and the cabinet drawer of FIG. 1.
Figure 8:
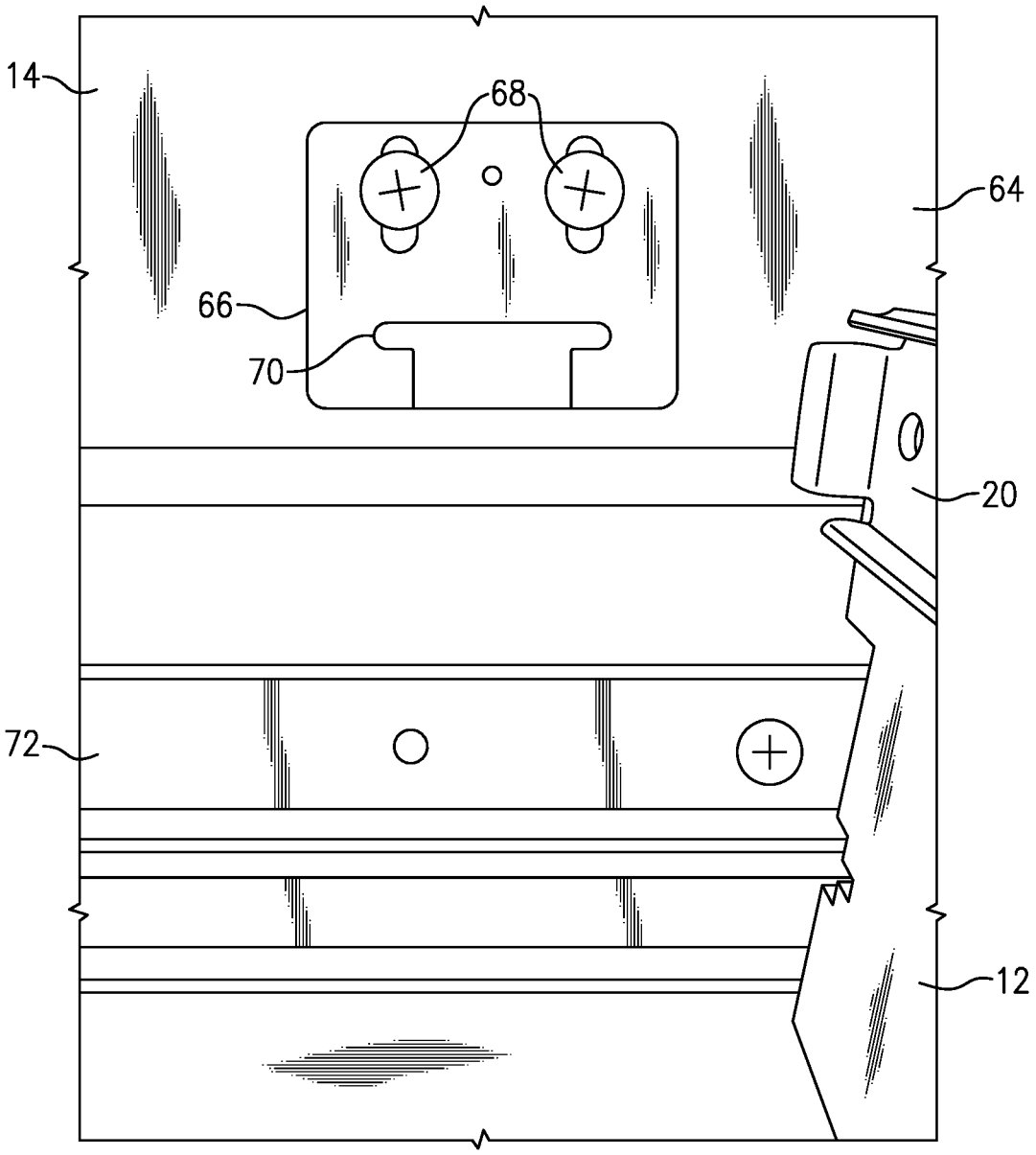
FIG. 8 illustrates a detail view of an attachment member for attaching the guide bar of FIG. 5 and the cabinet drawer of FIG. 1.

In the illustrated example of FIGS. 4, 7 and 8, the front end 54 of the guide bar 52 extends through the front opening 60 and engages a back side 64 of the drawer face 14. In one example, the back side 64 can include an attachment member such as attachment member 66 which is configured to receive fasteners 68 to fasten the front end 54 of the guide bar 52 to the drawer face 64. In a particular example, the attachment member 66 is situated within a recess 69 of the back side 64 so that it is approximately flush with the back side 64. The attachment member 66 may be integral with the guide bar 52 in some examples. In another example shown in FIG. 7, the attachment member 66 can include an attachment slot 70 that is configured to receive the front end 54 of the guide bar 52.

In the illustrated example of FIGS. 1B, 5, and 6, the rear end 56 of the guide bar 52 extends through the rear opening 62 such that the second projection 58*b* is situated outside of the drawer body 12.

In the illustrated example of FIGS. 5-7, the openings 60/62 have a width $W_1$ that is greater than a width $W_2$ of the guide bar 52 so that the guide bar 52 can move horizontally within the openings 60/62. In one example, the width $W_1$ of the openings 60/62 is about two inches.

Figure 9:
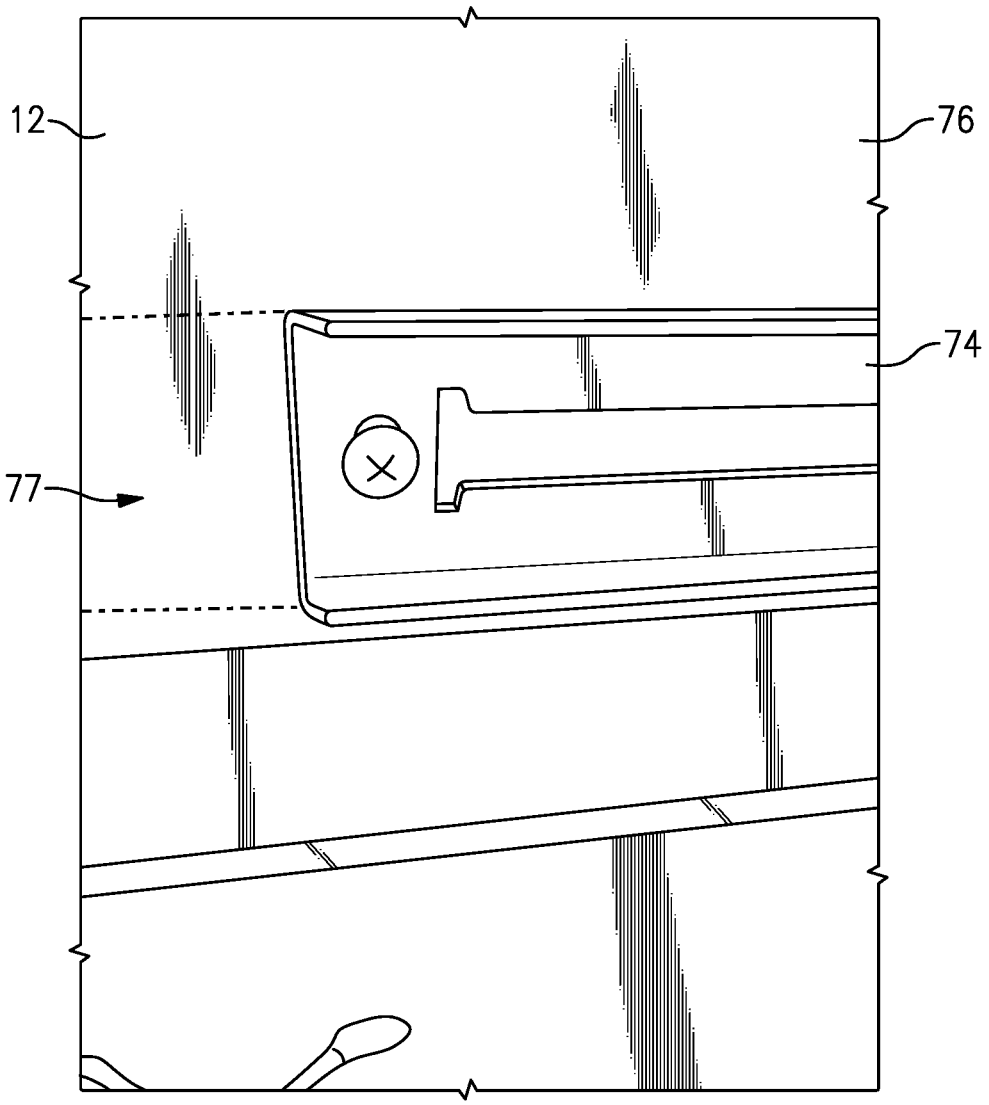
FIG. 9 illustrates a detail view of the cabinet drawer body in FIG. 1.

Referring to FIGS. 4, 8 and 9, the drawer face 14 is configured to slide horizontally with the front end 54 of the guide bar 52. In the illustrated example, a first bracket 72 is attached to the back side 64 of the drawer face 14, and a second bracket 74 is attached to a front face 76 of the body 12. In this example, the second bracket 74 is situated within a recess 77 of the front face 76.

The first bracket 72 is configured to receive the second bracket 74 so that the drawer face 14 can slide along the second bracket 74. In this example, the front end 54 of the guide bar 52 extends within the attachment slot 70 so that the drawer face 14 can slide horizontally with the front end 54 of the guide bar 52. With the first bracket 72 attached to the rear side 64 and the second bracket 74 situated within the recess 77 of the front side 76, a space is provided between the body 12 and the drawer face 14. In one example, the space is about one sixteenth of an inch. The space allows the drawer face 14 to slide with the guide bar 52 without interfering with the body 12.

Figure 10A:
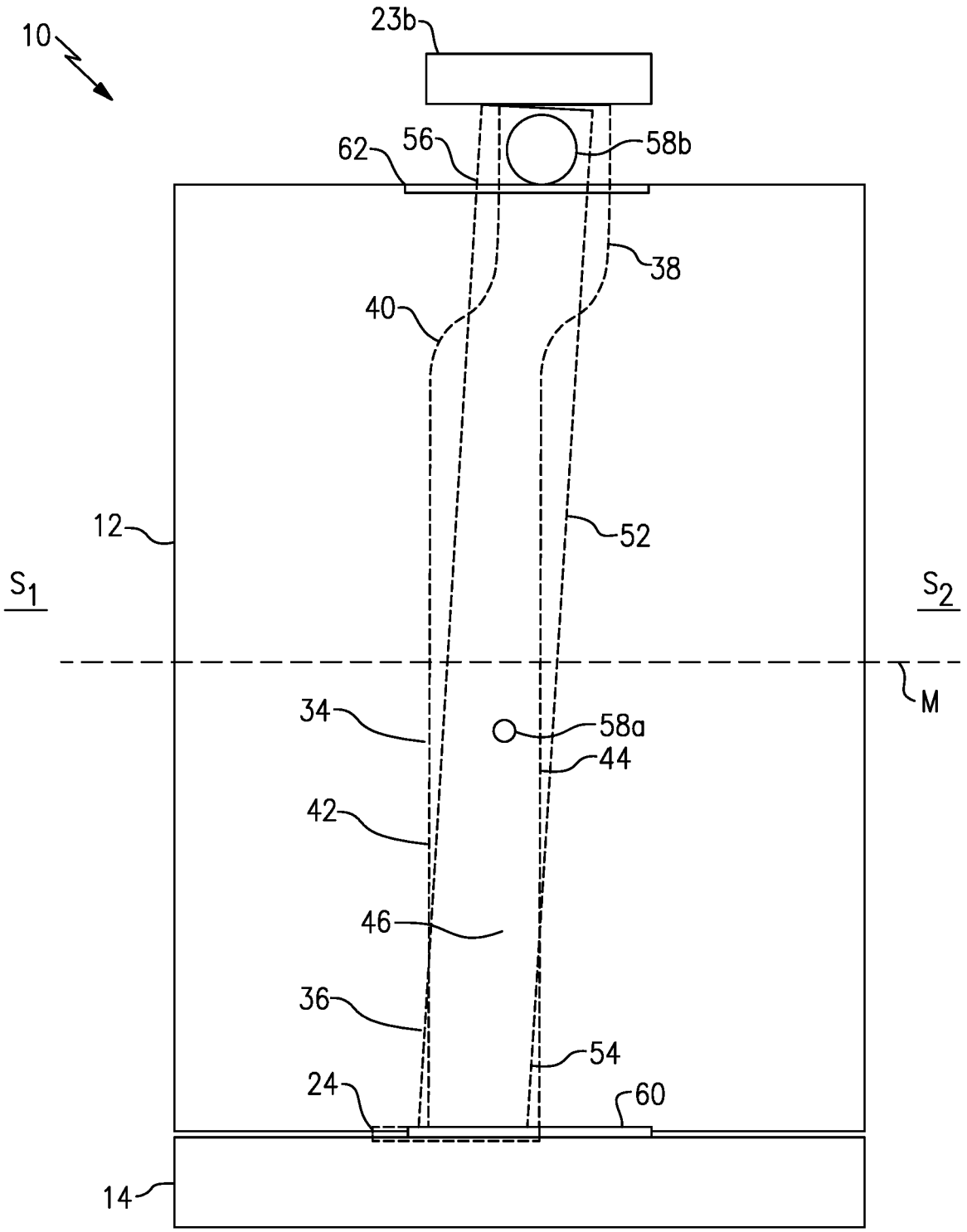
FIG. 10A schematically shows the cabinet drawer of FIG. 1 in a closed position.
Figure 10B:
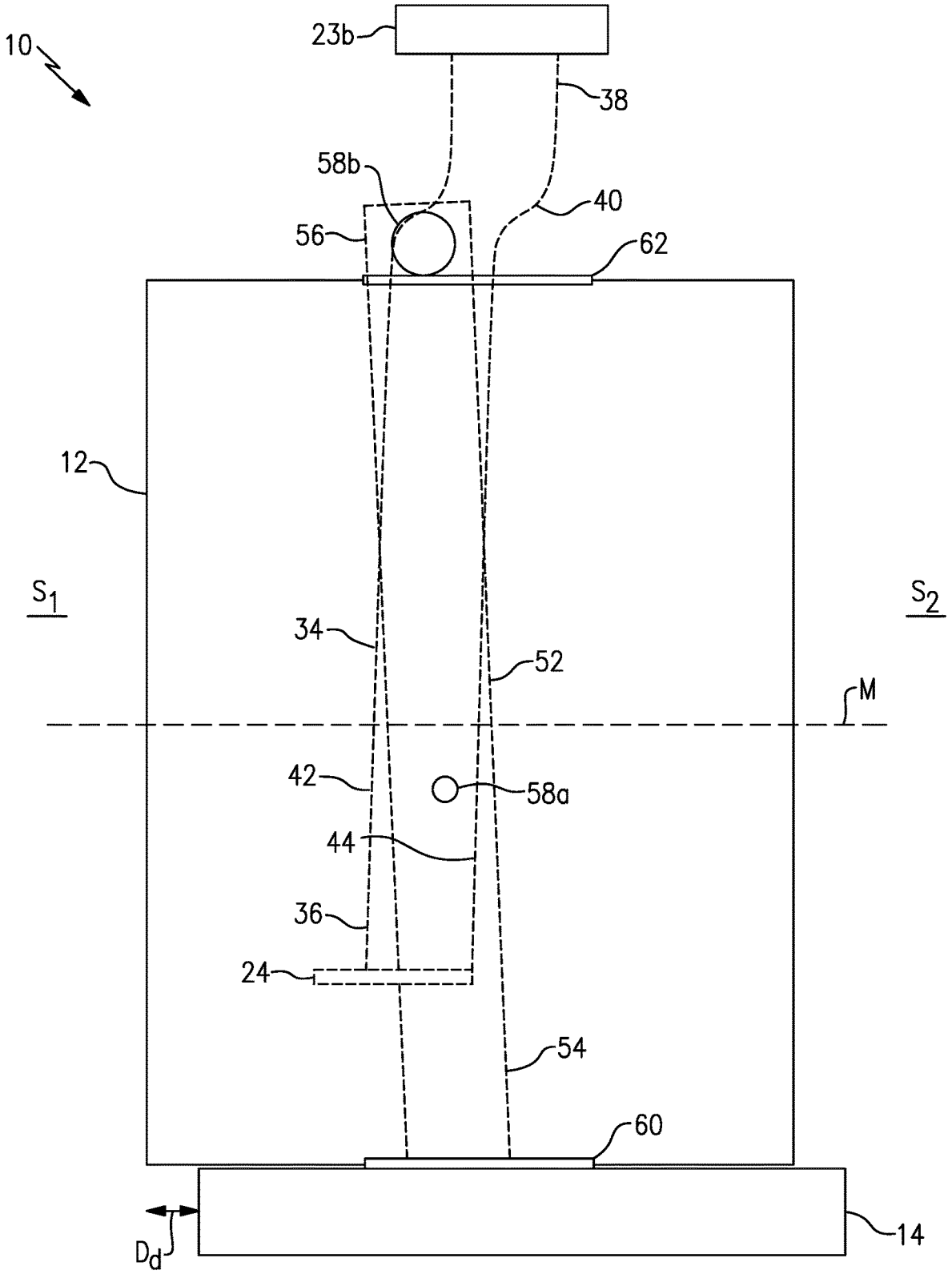
FIG. 10B schematically shows the cabinet drawer of FIG. 1 in an open position.

FIGS. 10A and 10B schematically illustrate operation of the guide member 34 and the guide bar 52 (each illustrated as dashed lines for illustrative purposes) when the cabinet drawer 10 transitions between a closed position (FIG. 10A) and an open position (FIG. 10B).

As shown in the example of FIG. 10A, the first projection 58*a* of the guide bar 52 extends over the guide rails 42/44 in the first section 36 of the guide member 34, and the second projection 58*b* of the guide bar 52 extends between the guide rails 42/44 in the second section 38 of the guide member 34.

As shown in the example of FIG. 10B, when the cabinet drawer 10 is pulled outward/forward from the closed position in FIG. 10A, the projections 58*a*/58*b* of the guide bar 52 move forward along the guide member 34. In this example, the first projection 58*a* continues to extend over the guide rails 42/44 in the first section 36, and the second projection 58*b* moves to the offset segment 40 of the guide member 34. In this example, when the second projection 58*b* reaches the second guide rail 44 in the offset segment 40, it is urged toward the first guide rail 42/the first side $S_1$ to the position shown in FIG. 10B. As a result, the rear end 56 of the guide bar 52 is urged horizontally within the rear opening 62 towards the first side $S_1$. The first projection 58*a* acts as a pivot point to simultaneously urge the front end 54 of the guide bar 46 horizontally within the front opening 60 to the second side $S_2$ as the rear end 56 is urged horizontally to the first side $S_1$. As discussed above with reference to FIG. 4, because the drawer face 14 is engaged with the front end 54 of the guide bar 52, the drawer face 14 moves horizontally to the second side $S_2$ with the front end 54 of the guide bar. Accordingly, the drawer face 14 is displaced a distance $D_d$ relative to the drawer body 12.

It will be appreciated that the distance $D_d$ is large enough to avoid interferences with a handle of an adjacent corner drawer 10/11 (FIG. 1A). In one example, the distance $D_d$ is less than the width $W_1$ of the openings 60/62. In a further example, the distance $D_d$ is about one inch.

As shown in the example of FIG. 10A, when the cabinet drawer 10 is pushed inward/backward from the open position in FIG. 10B, the projections 58*a*/58*b* of the guide bar 52 move backward along the guide member 34. In this example, the first projection 58*a* continues to extend over the guide rails 42/44 in the first section 36, and the second projection 58*b* moves to extend between the guide rails 42/44 in the offset segment 40 of the guide member 34. In this example, when the second projection 58*b* reaches the first guide rail 42 in the offset segment 40, the rear end 56 of the guide bar 52 is urged horizontally within the rear opening 62 towards the second guide rail 44/the second side $S_2$. The first projection 58*a* acts as a pivot point to simultaneously urge the front end 54 of the guide bar 46 horizontally within the front opening 60 to the first side $S_1$ as the rear end 56 is urged horizontally to the second side $S_2$. Accordingly, the displacement distance $D_d$ is removed and the drawer face 14 is returned to the position shown in FIG. 10A.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A cabinet drawer, comprising:

a drawer body;

a drawer face movable with respect to the drawer body; and a guide bar attached to an underside of the drawer body, the guide bar including a first end and a second end, the first end including a first projection and the second end including a second projection, each of the first and second projections extending away from the underside of the drawer body, wherein the second projection is configured to engage with a cabinet as a pivot point to urge the drawer face to move with respect to the drawer body.

2. The cabinet drawer of claim 1, wherein the drawer body includes a first bracket on a front side of the drawer body and the drawer face includes a second bracket on a back side of the drawer face, wherein the first bracket is configured to receive the second bracket such that the drawer face can slide with respect to the drawer body.

3. The cabinet drawer of claim 1, wherein the second projection has a first portion extending from the guide bar and a second portion rotatably connected to the first portion.

4. The cabinet drawer of claim 1, wherein the guide bar is attached to the underside of the drawer body via the first projection.

5. The cabinet drawer of claim 1, wherein the guide bar extends through an opening in the drawer body such that the second projection is situated outside of the drawer body.

6. The cabinet drawer of claim 1, wherein the first end of the guide bar is attached to a back of the drawer face.

7. The cabinet drawer of claim 1, wherein the first end of the guide bar extends through a first opening of the drawer body and is attached to the drawer face, and the second end of the guide bar extends through a second opening of the drawer body, and wherein, when the second projection engages with the cabinet, the second end of the guide bar moves horizontally within the second opening toward a first side of the drawer body and the first end of the guide bar moves horizontally within the first opening toward a second side of the drawer body.

8. The cabinet drawer of claim 7, wherein the first opening and the second opening each have a width greater than a width of the guide bar to permit horizontal movement of the guide bar within the first opening and the second opening.

9. A cabinet, comprising:

a guide member, the guide member including:

a first section defined along a first axis, a second section defined along a second axis, an offset segment connecting the first and second sections; and a drawer, the drawer including:

a drawer body;

a drawer face movable with respect to the drawer body, and a guide bar attached to an underside of the drawer body, the guide bar including a projection extending away from the underside of the drawer body and configured to engage with the offset segment of the guide member such that the projection acts as a pivot point to urge the drawer face to move with respect to the drawer body.

10. The cabinet of claim 9, wherein the first axis and the second axis are approximately parallel.

11. The cabinet of claim 9, wherein the first section of the guide member is longer than the second section of the guide member.

12. The cabinet of claim 9, wherein the first section of the guide member is received in a slot in a front wall of the cabinet, and wherein the second section of the guide member is attached to a back wall of the cabinet.

13. The cabinet of claim 9, wherein the projection is a second projection, and further comprising a first projection, the guide bar being attached to the underside of the drawer body via the first projection.

14. The cabinet of claim 9, wherein the guide bar extends through an opening in the drawer body such that the projection is situated outside of the drawer body.

15. The cabinet of claim 9, wherein the guide member includes first and second guide rails a wall joining the first and second guide rails, wherein the projection is configured to be received between the first and second guide rails, and wherein the projection is configured to engage with the first and second guide rails in the offset section to move the drawer face with respect to the drawer body.

16. A method of displacing a cabinet drawer, comprising:

moving a cabinet drawer with respect to a cabinet, the cabinet drawer including a drawer body, a drawer face movable with respect to the drawer body, and a guide bar attached to an underside of the drawer body with a projection extending therefrom, the projection engaged with a guide member including a first section defined along a first axis, a second section defined along a second axis, and an offset segment connecting the first and second sections such that the projection engages with the offset segment to urge the drawer face to move with respect to the drawer body.

17. The method of claim 16, wherein the guide member includes first and second guide rails and a wall joining the first and second guide rails, wherein the projection is received between the first and second guide rails and engages one of the first and second guide rails to urge the drawer face to move with respect to the drawer body.

18. The method of claim 16, wherein the guide bar extends through an opening in the drawer body such that the projection is situated outside of the drawer body.

19. The method of claim 16, wherein the first section of the guide member is longer than the second section of the guide member.

20. The method of claim 16, wherein the drawer is movable within the cabinet via drawer slides.

* * * * *